US007987532B2

(12) United States Patent
Bathurst et al.

(10) Patent No.: US 7,987,532 B2
(45) Date of Patent: Aug. 2, 2011

(54) RETRACTABLE SHOWER EXPANDER ASSEMBLY

(76) Inventors: David B. Bathurst, Clinton Township, MI (US); Veronica L. Bathurst, Clinton Township, MI (US)

( * ) Notice: Subject to any disclaimer, the term of this patent is extended or adjusted under 35 U.S.C. 154(b) by 0 days.

(21) Appl. No.: 12/661,283

(22) Filed: Mar. 15, 2010

(65) Prior Publication Data

US 2010/0170034 A1 Jul. 8, 2010

Related U.S. Application Data

(63) Continuation-in-part of application No. 11/171,991, filed on Jul. 1, 2005, now abandoned.

(60) Provisional application No. 60/616,330, filed on Oct. 6, 2004.

(51) Int. Cl.
*A47K 3/08* (2006.01)
*A47K 3/14* (2006.01)

(52) U.S. Cl. ..... 4/558; 4/557; 4/607; 4/608; 4/610

(58) Field of Classification Search ..... 4/557, 558, 4/607, 608, 610; 49/425
See application file for complete search history.

(56) References Cited

U.S. PATENT DOCUMENTS

| | | | | |
|---|---|---|---|---|
| 0,699,786 | A | | 5/1902 | Campbell |
| 2,185,305 | A | | 1/1940 | Marchand |
| 2,188,163 | A | | 1/1940 | Sherman |
| 2,212,326 | A | | 8/1940 | Piker |
| 2,232,194 | A | | 2/1941 | Zogby |
| 2,239,630 | A | | 4/1941 | Tendrian et al. |
| 2,303,502 | A | | 12/1942 | Rous |
| 2,313,421 | A | | 3/1943 | Dalton, Jr. |
| 2,454,434 | A | | 11/1948 | Cunningham |
| 2,500,350 | A | | 3/1950 | Endres |
| 2,573,985 | A | | 11/1951 | Porter |
| 2,608,250 | A | | 8/1952 | Meyer |
| 2,613,368 | A | | 10/1952 | Rosenbaum |
| 2,668,298 | A | | 2/1954 | Kimmons |
| 2,751,150 | A | | 6/1956 | Buccicone |
| 2,771,945 | A | | 11/1956 | Wittrup |
| 2,774,974 | A | | 12/1956 | Zaloga |
| 2,778,030 | A | * | 1/1957 | Goche ..... 4/608 |
| 2,840,160 | A | | 6/1958 | Tichenor |
| 2,862,211 | A | | 12/1958 | Shabarman et al. |
| 2,878,487 | A | | 3/1959 | Foote |
| 3,104,014 | A | | 9/1963 | Piette |
| 3,418,665 | A | | 12/1968 | Long |
| 3,872,520 | A | | 3/1975 | Tyconik |
| 4,070,735 | A | | 1/1978 | Canaday |
| 4,117,557 | A | * | 10/1978 | McPeak et al. ..... 4/610 |
| 4,754,504 | A | | 7/1988 | Cellini |
| 4,771,517 | A | | 9/1988 | Bonanno |
| 4,825,481 | A | | 5/1989 | Lonberger |
| 5,023,964 | A | | 6/1991 | Unsworth |

(Continued)

*Primary Examiner* — Tuan Nguyen

(57) ABSTRACT

A shower curtain support system consists of a support guide member having a center portion, two opposing ends, two holders, and an attached shower curtain. The two holders are fixedly attached to the two opposing end walls of a shower stall or tub enclosure, and are usably adjoined, one on each end, to the support guide member. Each holder consists of a roller bracket having rollers and spacers attached to the roller bracket. The rollers communicate with the longitudinal slots on each of the two opposing ends of the support guide member. The support guide member is movable between a first extended position wherein the support guide member, with an attached shower curtain, is extended out at the top creating a maximum amount of space inside the shower stall or tub enclosure. In the second position the support guide member is retracted within the space defining the shower stall or tub enclosure.

9 Claims, 9 Drawing Sheets

U.S. PATENT DOCUMENTS 5,031,257 A 7/1991 Jeffery
5,033,132 A 7/1991 Greenblatt
5,083,330 A 1/1992 Dusar
5,097,541 A 3/1992 Annand
5,101,522 A * 4/1992 Prian ..... 4/610
5,216,766 A 6/1993 Lang
5,339,884 A 8/1994 Angerman
5,345,623 A 9/1994 Dearman
5,345,624 A 9/1994 Brown, III
5,345,992 A 9/1994 Turner
5,351,739 A 10/1994 Levy
5,402,842 A 4/1995 Ruggiero
5,421,393 A 6/1995 Wolfe
5,426,821 A * 6/1995 Story ..... 4/610
5,447,244 A 9/1995 Mentzer
5,495,628 A 3/1996 Logan
5,543,196 A 8/1996 Robinson et al.
5,651,407 A 7/1997 Perez
5,662,297 A * 9/1997 Christensen et al. ..... 4/610
5,673,962 A 10/1997 Maieli et al.
5,771,504 A 6/1998 Steiner
5,787,954 A 8/1998 Herrera
5,809,589 A 9/1998 Johnson
5,901,769 A 5/1999 Farley
5,947,603 A 9/1999 Tilman
5,950,255 A 9/1999 Thompson
5,974,603 A 11/1999 Frazier
6,032,306 A 3/2000 Gummin
6,038,749 A 3/2000 Eberhardt
6,041,454 A 3/2000 Summerford
6,049,920 A 4/2000 Mochizuki
6,098,699 A 8/2000 Junius
6,163,899 A 12/2000 Leonard
6,192,965 B1 2/2001 Hinds
6,289,967 B1 9/2001 Moore
6,394,168 B1 5/2002 Zoboski
6,488,070 B1 12/2002 Cox
6,499,708 B1 * 12/2002 Cowen ..... 248/261
6,565,144 B1 5/2003 Crean
6,715,163 B1 * 4/2004 Cunningham ..... 4/558
6,845,525 B2 1/2005 Bathurst

* cited by examiner

RETRACTABLE SHOWER EXPANDER ASSEMBLY

RELATED APPLICATIONS

This application is a Continuation-In-Part of U.S. application Ser. No. 11/171,991 filed Jul. 1, 2005 now abandoned which claims priority pursuant to 35 U.S.C. 119 from Provisional Patent Application Ser. No. 60/616,330 filed Oct. 6, 2004. The entire disclosures of both applications are hereby incorporated by reference.

FIELD OF THE INVENTION

The present invention relates to shower compartments, shower stalls, or tub enclosures and more specifically relates to a shower curtain support system to portably and temporarily expand a shower curtain and increase the usable interior area of shower compartments, stalls, or tub enclosures and then retract the shower curtain to conserve space outside of the shower compartment, shower stall, or tub enclosure and be more aesthetically pleasing when not in use.

BACKGROUND OF THE INVENTION

Since the invention of the bathtub, and more particularly the apparatus used for holding a shower curtain to cover and protect the bathing area from water leakage, little has changed to increase the amount of space needed to shower and thereby improve the comfort level for the user. Various attempts in the past have been made, such as the curved shower rod, which permanently extends the shower curtain outside of the access opening. That device is used in some hotels for the convenience of the guests. However, that invention has limitations for use in the home as it takes away usable space from the bathroom outside of the shower stall or tub enclosure and can be less aesthetically pleasing. This severely limits the practical appeal and broader application for that invention. Yet another drawback is that the curved shower rod requires that it be permanently mounted or affixed to the shower stall or tub enclosure walls. In many homes this application may prove difficult or not feasible to retrofit, and often, even when it can be done, it interferes with fully opening the bathroom door without the door bumping into the curved shower rod. Further, the curved shower rod is limited in the amount of increased shower area that it can provide as the additional space is only in the middle portion of the shower rod where the rod curves outward, and not on the ends where the curved rod tapers back to the access opening.

A standard size tub having a shower stall or tub enclosure, and having a shower curtain to cover the access opening is very limited in size and comfort, as is the case in most homes. The demand for larger size accommodations for bathing is relatively new in homes today, and therefore older homes and even most of the newer ones still employ a standard size tub or shower area, and they would benefit greatly from having increased area in the shower stall or tub enclosure. A typical small shower stall or tub enclosure with a shower bar or tension rod and an attached shower curtain severely limits the movement of the users upper torso, and impedes their forward and backward movement within the shower area because of the nature of the shower environment which causes the shower curtain to billow in or attach itself to the users body when it is wet. This lack of usable area inside of a shower environment and the limitations of the shower stall or tub enclosure, due to their size, greatly detracts from the comfort level of the user.

Also, with persons having disabilities, or the elderly, the small shower environment is even more limiting in comfort and scope of use while showering. Simply getting into a small shower stall or tub enclosure and then positioning and repositioning oneself inside while showering is very problematic and extremely difficult for many in this condition, as tub seats, hand rails and other equipment are usually necessary in the tub or shower environment to assist the handicapped or the elderly. These items tend to come into contact with the shower curtain when wet from the shower environment and the shower curtain will either stick to either the equipment or to the user or both.

However, It can be very impractical to alleviate this situation, either because the small size of an existing bathroom is restrictive or that it is cost prohibitive or even impractical to remodel or enlarge a small tub or shower enclosure. It is the intent of the present invention to particularly address the many disadvantages and drawbacks of a typical small shower stall or tub enclosure, and provide relief in the form of a new and useful device for fully increasing the usable space inside a shower stall or tub enclosure along the entire length of the access opening, and making the additional increased space portably usable and temporary, so as not to diminish or take away any bathroom space outside of the shower stall or tub enclosure.

SUMMARY OF THE INVENTION

In the preferred embodiment the shower curtain support system includes a support guide member, having a center portion which is formed at right angles on the two opposing ends, and the ends having slots therein. The support guide member is adaptable in length, so as to fit various sizes of shower stalls or tub enclosure access openings. A shower curtain is attached by rings or hooks to the center portion of the support guide member. Two holders are provided, one usably attached on each end of the support guide members. Each holder comprises a roller bracket having through apertures for mounting the roller bracket, by means of fasteners, to the surrounding walls directly abutting the tiled or covered area inside of a shower stall or tub enclosure near the top of the access opening. An adjoining appendage on each of the roller brackets projects through the access opening and into the interior space of the shower stall or tub enclosure. Attached to each of the appendages are two rollers and spacers. The support guide member is thus held and rotatably moves by means of the rollers and spacers attached to the roller brackets, and which rollers and spacers communicate with and rotate inside the hollow interior and slotted opposing ends of the support guide member, and propel the support guide member, alternately, between two positions. Retainers are affixed on each end of the support guide member to keep the support guide member from disengaging the roller brackets and to hold the support guide member at a fixed extended distance.

In the extended, or first fixed position, the support guide member projects or telescopes the top portion of the attached shower curtain outward through the access opening of the shower stall or tub enclosure, along the entire length of the access opening, and on an angle to the bottom of the shower curtain, which bottom portion remains inside the tub or shower area, and then selectively maintains the angular position of the shower curtain during the use of the shower, so as to effect an increase of usable space within the shower stall or tub enclosure by 50% or more, where it is needed most, for the users upper torso and arm movements. In the retracted, or second fixed position, the support guide member is positioned inward, toward the interior of the shower stall or tub enclosure, with the shower curtain hanging straight, again, in the access opening, so as to conserve space in the bathroom area outside of the shower stall or tub enclosure, and to be more aesthetically pleasing than a stationary curved shower rod.

As an alternative, the shower curtain support system of the present invention may retrofit or replace an existing stationary straight or curved shower rod inside of a shower stall or tub enclosure, by means of an alternate embodiment of the two outside wall mounted holders. The holders, instead, each have an alternately configured roller bracket with two opposing appendages, and each appendage has one roller and one spacer affixed thereon by means of a fastener. This configuration allows for the shower curtain support system to use the same support guide member, and instead, be mounted on the inside of the shower walls or tub enclosure, by utilizing the same hole patterns and fastener types as were previously used for the existing stationary straight or curved shower rod. However, if there is no existing stationary straight or curved shower rod, new mounting holes would need to be drilled for the alternate holders. In both instances, the desired outcome is to provide for increased additional space inside of a shower stall or tub enclosure that is portably usable and temporary, and which does not permanently take away space or area outside of the shower stall or tub enclosure.

Other methods and applications of the present invention will become readily apparent and obvious, not only to those skilled in the art, but to anyone of ordinary understanding, when contemplating the following description of the best or preferred mode of the invention herein described, in conjunction with the accompanying drawings.

BRIEF DESCRIPTION OF THE DRAWINGS

The descriptions herein makes reference to the accompanying drawings wherein like reference numerals refer to like parts in the several views throughout, and wherein.

DETAILED DESCRIPTION OF THE INVENTION

Figure 10:
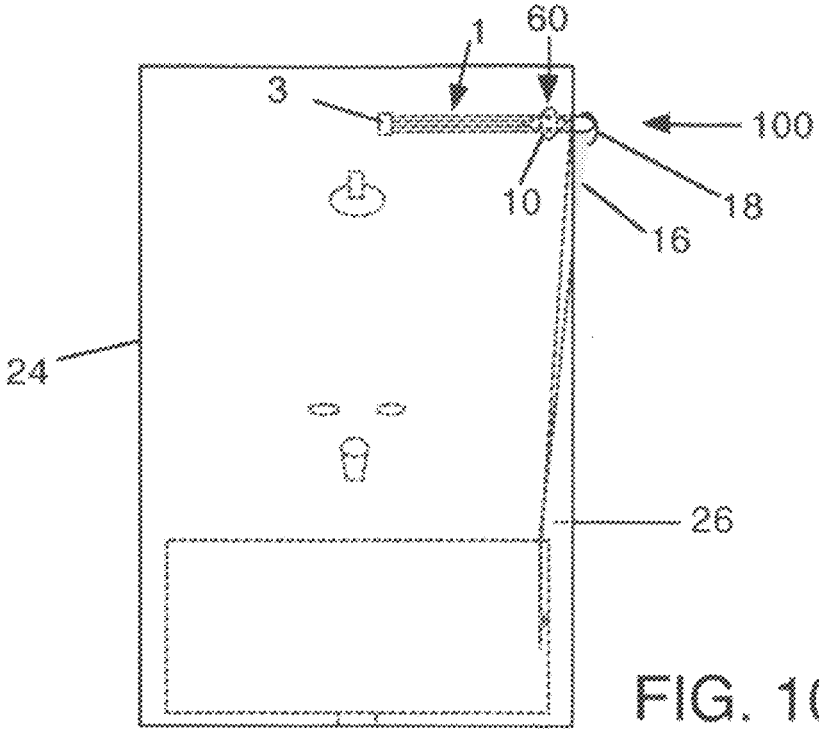
FIG. 10 shows an end view perspective of the outside of a tub enclosure, having the shower curtain support system of the present invention usably affixed to the inside of the shower wall with an alternate embodiment of the holders, and shown in the retracted or second fixed position with a shower curtain attached.

Illustrated in FIG. 10, 11, is a typical shower stall or tub enclosure 24, which is rectangular or square in configuration, having three walls surrounding a tub or shower stall and an access opening 26 serving as the fourth wall, which is alternately covered by a shower curtain 16 for the ingress and egress of the user. A shower bar or tension rod extends the length of the access opening 26 near the top and is held in place against the inside of the two end walls of the shower stall or tub enclosure 24 by either screws or tension force. The shower bar or tension rod, as are commonly well known, are typical of those used in most homes for holding a shower curtain 16 stationary between the access opening 26 of a shower stall or tub enclosure 24 for the purpose of showering or bathing and keeping the water confined within the tub or shower area. A shower curtain 16 is connected to the shower bar or tension rod by hooks or rings 18 that slide along the length of the shower bar or tension rod to selectively close or open the access opening 26.

Figure 11:
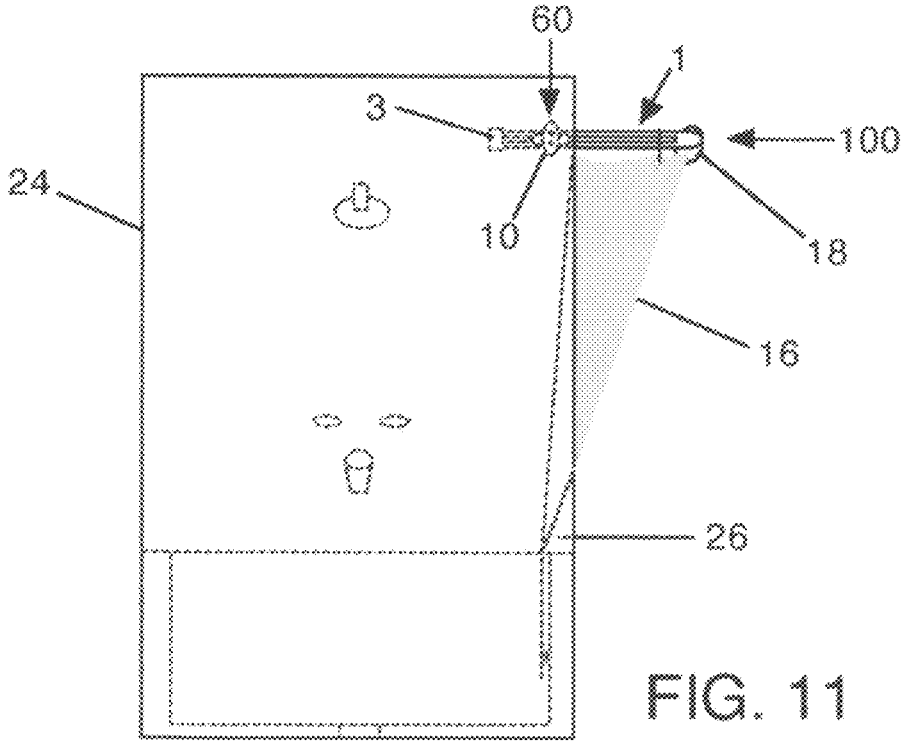
FIG. 11 shows an end view perspective of the outside of a tub enclosure, having the shower curtain support system of the present invention usably affixed to the inside of the shower wall with an alternate embodiment of the holders, and shown in the extended or first fixed position with a shower curtain attached.

The shower curtain support system 100 of the present invention creates an increased amount of shower space which is portably usable and alternately extendable, in a first fixed position FIG. 11, or retractable, in a second fixed position FIG. 10, and is adaptable in length so as to fit various size shower stalls or tub enclosures 24 within most homes or dwellings. In the extended or first fixed position FIG. 11 the shower curtain support system 100 increases the usable area inside a shower stall or tub enclosure 24 by fifty-percent or more, by holding and maintaining the attached shower curtain 16 on an angle from the top to the bottom, where the shower curtain 16 remains within the shower stall or tub enclosure, providing more room at the top of the shower curtain for the users upper torso and arm movements, where it is needed the most, along the entire length of the top of the access opening 26, and also prevents the shower curtain 16 from billowing in on the user or touching parts of their clean body. When in the retracted or second fixed position FIG. 10, the shower curtain support system 100 returns the shower curtain 16 to a straight hanging position within the access opening 26 and conserves bathroom space outside of the shower stall or tub enclosure 24 and is more aesthetically pleasing, and not obtrusive, as are curved shower rods.

Figure 1:
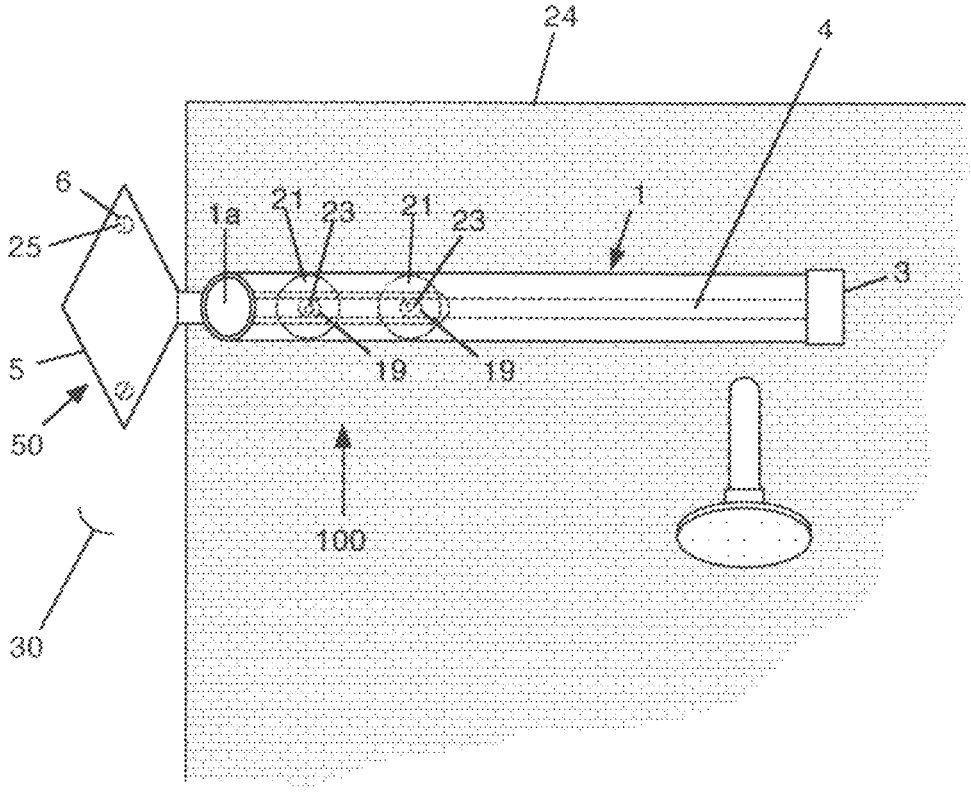
FIG. 1 shows a cutaway perspective view of the left end wall inside of a tub enclosure, with a portion of the preferred embodiment of the shower curtain support system, in the retracted or second fixed position.
Figure 2:
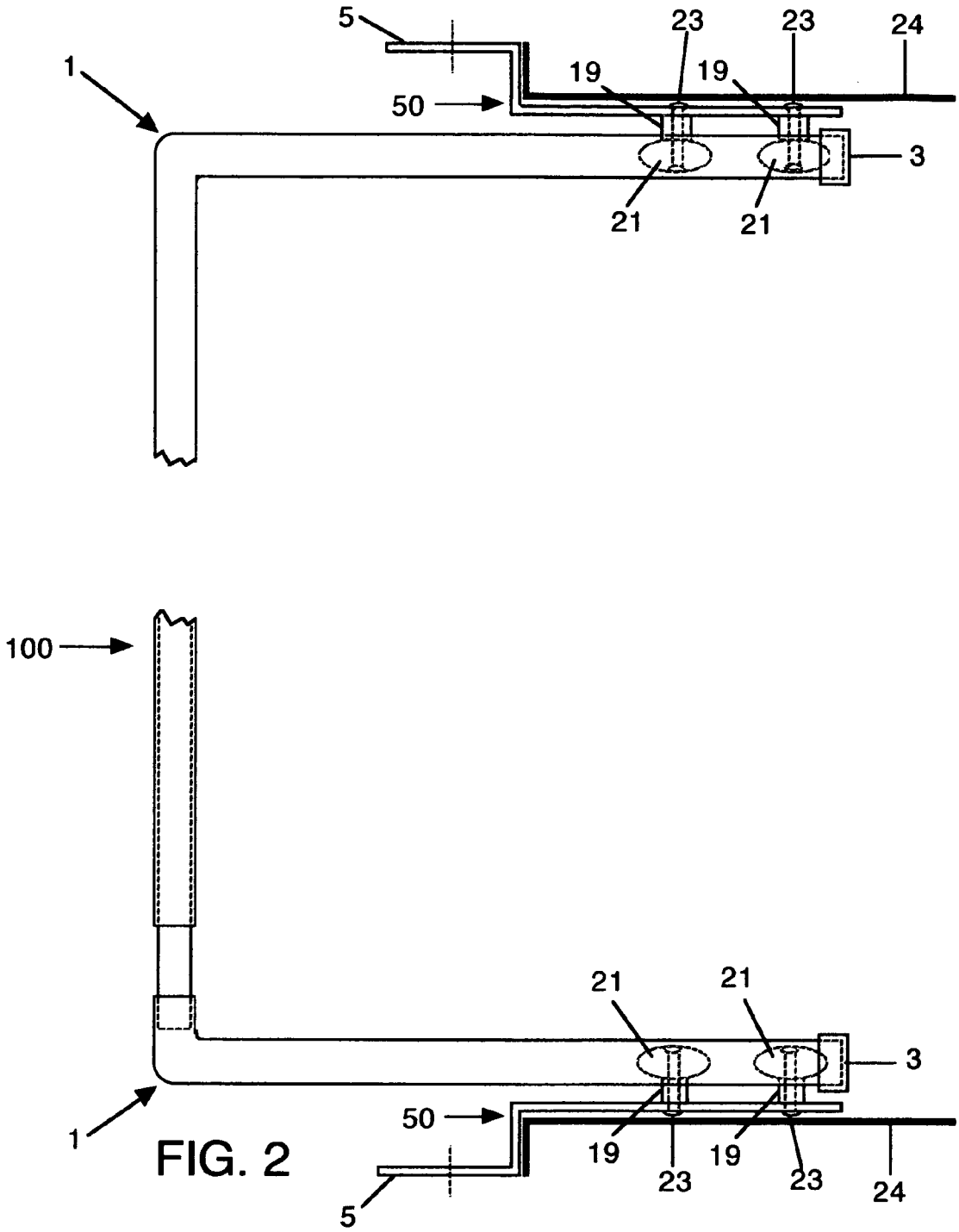
FIG. 2 shows a top or birds-eye perspective view of the preferred embodiment of the shower curtain support system, in the extended or first fixed position.

FIGS. 1 and 2 show the preferred embodiment of the shower curtain support system 100, comprising a support guide member 1 having retainers 3, two holders 50, with each holder consisting of a roller bracket 5, two rollers 21, two spacers 19, and two fasteners 23. The support guide member 1 is oval and hollow on the interior 1*a*, and formed with right angles on each end, and being made of metal, plastic, or other rigid material. On each of the perpendicular ends of the support guide member 1 are slots 4 that face outward, toward the shower walls, and extend a prescribed length on the support guide member 1 ends. It is anticipated that the larger outside diameter of the support guide member 1 to be one inch. Communicating with the support guide member 1 are two holders 50 which are affixed, one on each end, to the two opposing outer walls 30 surrounding the shower stall or tub enclosure 24, and directly abut the shower tile or protective covering near the top of the access opening 26, by means of fasteners 25 disposed through holes 6 in the roller brackets 5 and into the outer walls 30. The support guide member 1 is usably attached to the roller bracket 5 arms of the holders 50, and the ends of the support guide member 1 are capped with retainers 3, to both limit the outer movement of the support guide member 1 when it is in the extended or 1st position, and to prevent it from becoming disengaged from the roller bracket 5 arms. A shower curtain 16 is attached by rings or hooks 18 to the support guide member 1, as illustrated in FIGS. 10 and 11, to keep water from the shower confined within the shower stall or tub enclosure, and so as to form a complete shower curtain support system 100.

Figure 3:
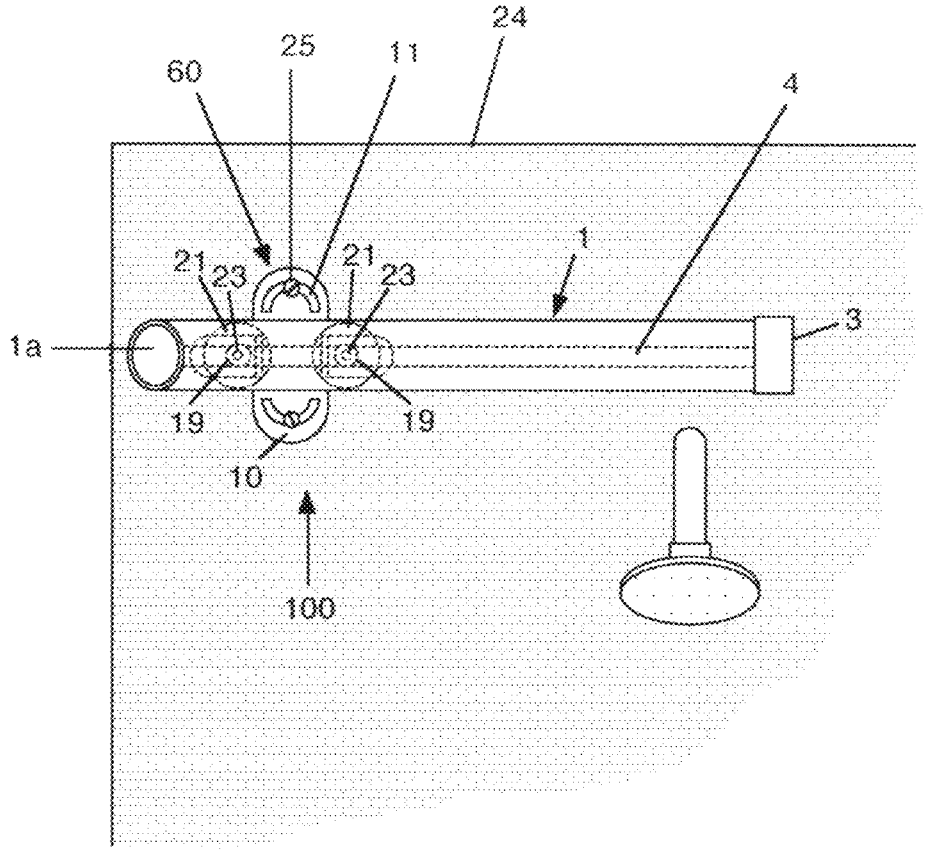
FIG. 3 shows a cutaway perspective view of the left end wall inside of a tub enclosure, with a portion of an alternate embodiment of the shower curtain support system, in the retracted or second fixed position.
Figure 4:
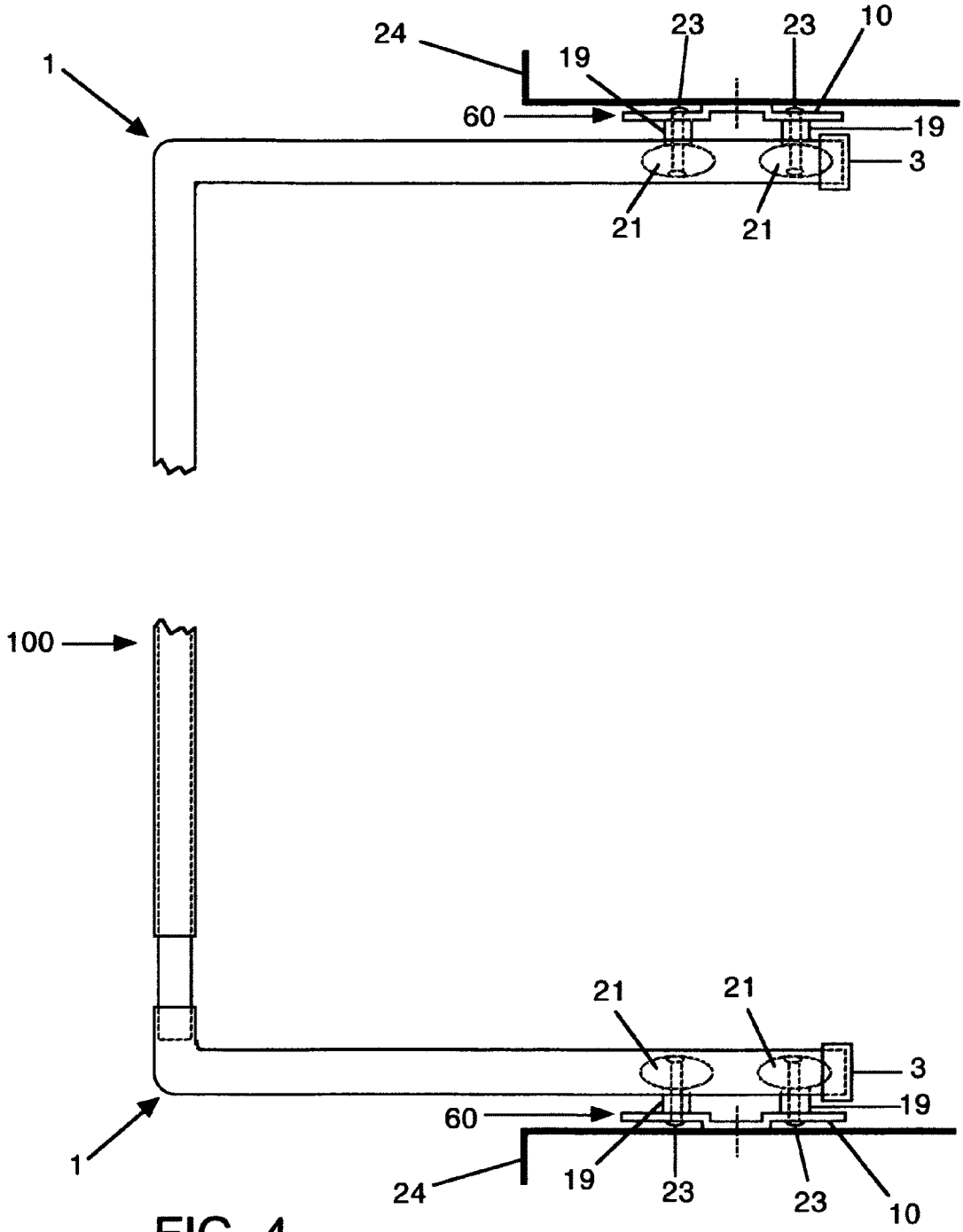
FIG. 4 shows a top or birds-eye perspective view of an alternate embodiment of the shower curtain support system, in the extended or first fixed position.

FIGS. 3 and 4 show the shower curtain support system 100 with an alternate holder 60. The support guide member 1 is the same support guide member 1 as described and stated supra in the preferred embodiment, and said support guide member 1 may be used interchangeably with either holder 50 or holder 60. Each of the alternate holders 60 is comprised of; a roller bracket 10, two rollers 21, two spacers 19, and two fasteners 23. In this case, the roller brackets 10 are of a reconfigured retrofit design, each having two elongated mounting slots 11 that are adaptable so as to fit various existing hole patterns from the previous stationary shower bar or rod. The two alternate holders 60 are fixedly attached to the inner walls of the shower stall or tub enclosure 24, one on each end, by utilizing the same mounting holes and fastener types as previously employed to hold an existing stationary shower bar or rod, thus eliminating the need to drill new holes. In this manner a previous stationary shower bar or rod is replaced with the new shower curtain support system 100. However, with a new installation, where there is no existing stationary shower bar or rod, new mounting holes would need to be drilled into the shower walls. The support guide member 1 is then usably attached onto the alternate holders 60, and the ends are capped with retainers 3, so that when combined with a shower curtain 16 the combined members form a complete shower curtain support system 100.

Figure 6:
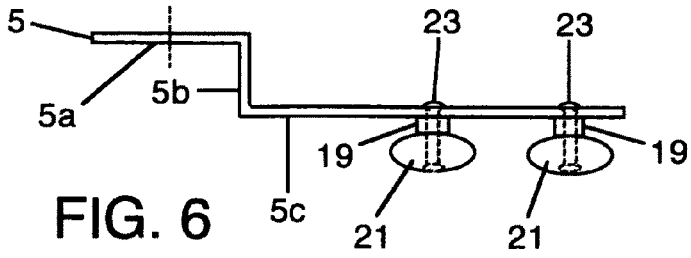
FIG. 6 shows a top view of a multi view orthographic representation of the preferred embodiment of the holder.
Figure 5:
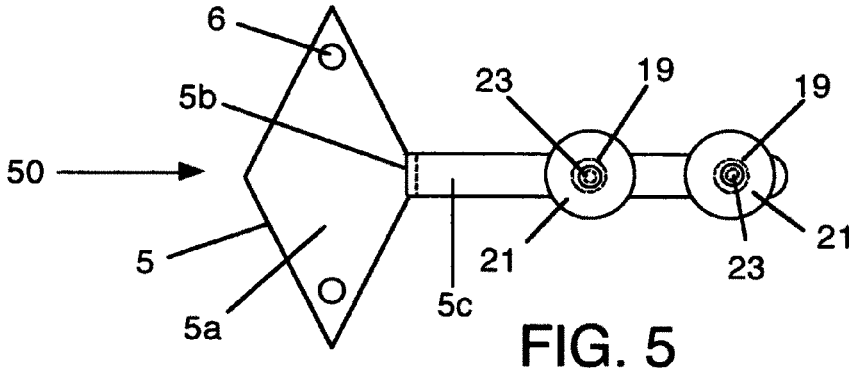
FIG. 5 shows a front view of a multi view orthographic representation of the preferred embodiment of the holder.

FIGS. 5 and 6 show two orthographic perspectives, front and top, of the preferred embodiment of the holder 50. Each of the two holders 50 that are required for the shower curtain support system 100 is comprised of; a roller bracket 5, two rollers 21, two spacers 19 and two fasteners 23. The roller bracket 5 has a planar surface 5*a*, with through holes for affixing the roller bracket 5 to each of the two end walls, and an adjoining appendage or arm which forms a second planar surface 5*b* that projects outwardly at a right angle from the first planar surface 5*a* a prescribed distance, so as to extend the appendage or arm beyond the edge of the tile or protective covering on the inside walls of a shower stall or tub enclosure 24. A third planar surface 5*c* adjoins the second planar surface 5*b* of the roller bracket 5, and forms an appendage or arm extending at a right angle to the second planar surface 5*b*, and which appendage or arm is offset, having the same orientation as the first planar surface 5*a*, and protrudes inward and through the access opening 26 into a shower stall or tub enclosure 24, near the top, so that the appendage or arm of the roller bracket 5 is parallel to the tile or other protective covering on the inside of a shower stall or tub enclosure 24. On each of the roller brackets 5 are two rollers 21, being round and each having two planar sides with an oval shaped edge for a rolling surface. The two rollers 21 are combined with the two spacers 19, one of each kind in pairs, having adjoining apertures, and are affixed by fasteners 23 to the roller bracket planar surface 5*c* at a set distance apart from each other. Together, each paired roller 21 and spacer 19 contacts and communicates with the hollow interior 1*a* and slots 4 on each of the perpendicular ends of the support guide member 1, and hold the support guide member 1 in a horizontal position, and at a set space away from the inside shower walls 30 on both ends, while allowing for the support guide member 1 to contact and move by means of the rollers 21 and spacers 19. On each end of the support guide member 1 is a retainer 3 cap, which serves as a means to prevent the support guide member 1 from disengaging the two holders 50, and to keep the support guide member at a set distance outward when in the extended or first fixed position. For mounting purposes, when the support guide member 1 is assembled onto the holders 50, the retainer 3 caps are first removed, and the end slots 4 serve as a means of alignment for the support guide member 1 to engage and slide onto the rollers 21 and spacers 19 on each of the appendages or arms of the roller brackets 5. Once the support guide member 1 is installed onto the holders 50, the retainer 3 caps are replaced. In this manner the support guide member 1 can telescope, and alternately extend or retract an attached shower curtain 16 through the access opening 26, as it glides over the rollers 21 and spacers 19, so as to provide increased space within a shower stall or tub enclosure, that is portably usable and temporary, and not to take away or protrude into space outside of the shower stall or tub enclosure.

Figure 8:
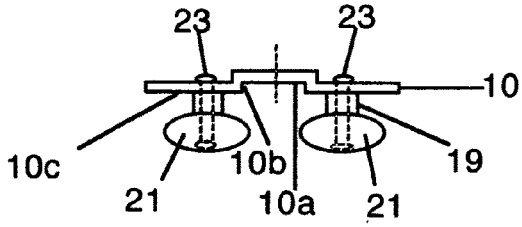
FIG. 8 shows a top view of a multi view orthographic representation of an alternate embodiment of the holder.
Figure 7:
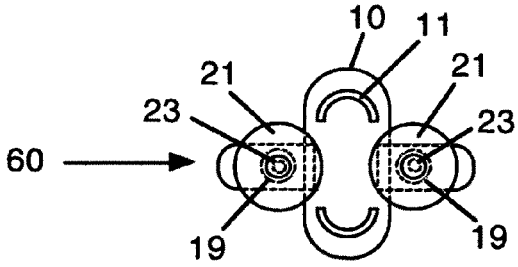
FIG. 7 shows a front view of a multi view orthographic representation of an alternate embodiment of the holder.
Figure 9:
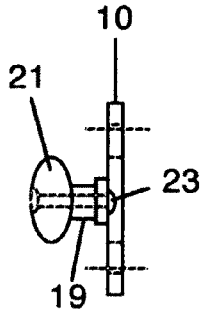
FIG. 9 shows a side view of a multi view orthographic representation of an alternate embodiment of the holder.

FIGS. 7, 8, and 9 represent various orthographic perspectives; front, top, and side of the alternate holder 60. Each of the two holders 60 that are required for the shower curtain support system is comprised of; a roller bracket 10, two rollers 21, two spacers 19 and two fasteners 23. The roller bracket 10 has a center planar surface 10*a* and two slots 11 for adjustment, which together form the mounting portion of the roller bracket 10, for attaching the roller bracket to each of the inside opposing end walls of a shower stall or tub enclosure. Two adjoining appendages, one on each side of the center planar surface 10*a*, project at right angles from the first planar surface 10*a* to form two opposing planar surfaces 10*b*, and, which two planar surfaces 10*b*, extend away from the shower wall a prescribed distance, parallel to each other, and then again are configured at right angles, in opposite directions from each other, to form two third planar surfaces 10*c*, so that the two adjoining appendages are bilaterally symmetrical and offset, and are parallel to the inside shower walls. Attached to each of the third planar surfaces 10*c* are one roller 21 and one spacer 19, one of each kind in pairs, having through apertures, and which pairs are usably adjoined by fasteners 23 through the apertures in the roller bracket 10, one aperture in each of the third planar surfaces 10*c*, at a set distance apart, so that the rollers 21 and spacers 19 may contact and communicate with the hollow interior 1*a* of the support guide member 1 and slots 4 on the perpendicular ends, and provide a means for holding and traversing the support guide member 1 horizontally between two fixed positions.

FIG. 10 shows the shower curtain support system 100 in the second or retracted position, having the alternate holders 60.

FIG. 11 shows the shower curtain support system 100 in the first or extended position, having the alternate holders 60.

Figure 12:
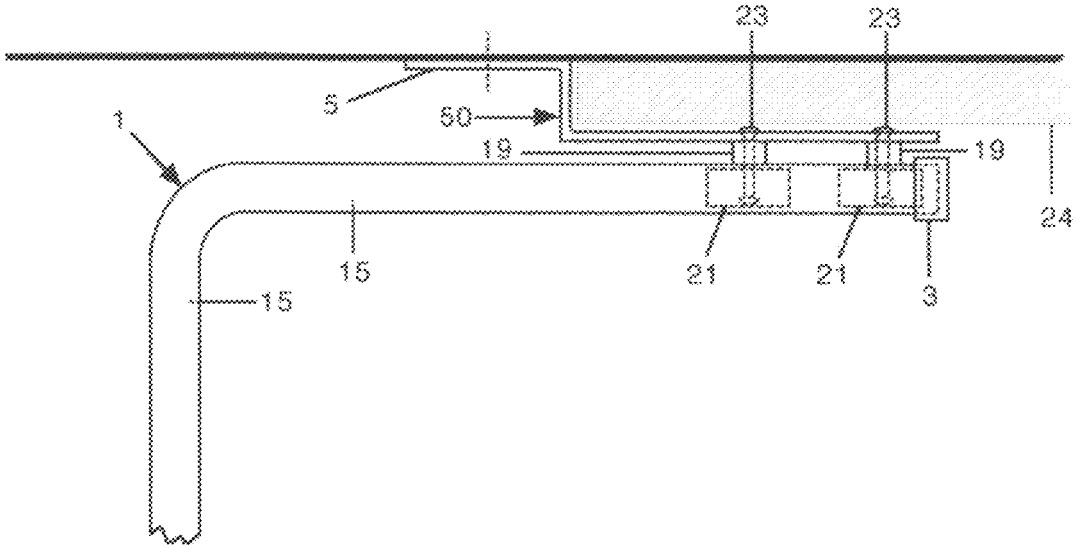
FIG. 12 shows a top or birds eye view of the left side portion of an alternate embodiment of the support guide member, having a rectangular shaped rod, and flat edge rollers, and wherein the right side portion, not shown, is a mirror image.
Figure 13:
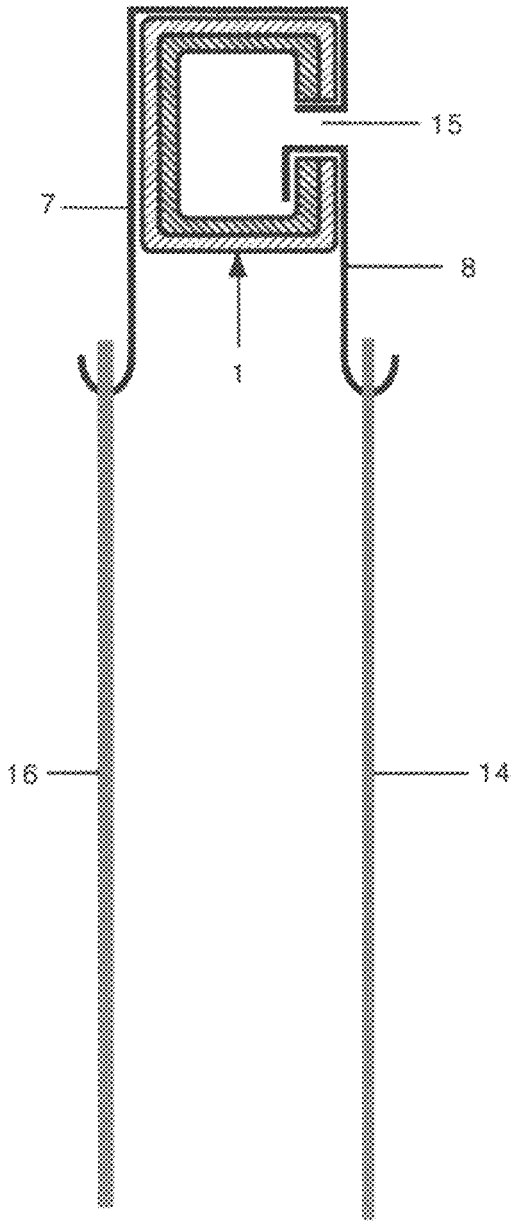
FIG. 13 shows an expanded cutaway view of an alternate embodiment of a support guide member, with the support guide member having a side aperture for holding both a shower liner, and a shower curtain, each on opposite sides and independently movable of each other, with separate hangers for each.

FIGS. 12 and 13 show another embodiment of the shower curtain support system 100. The support guide member 1, having a dual purpose, is rectangular, to show that other configurations and geometric shapes are conceivable. On the inside planar surface of the center portion and on a prescribed portion on both of the perpendicular ends of the dual purpose support guide member 1 is a slot 15 to hold and traverse hangers 8, with an attached shower liner 14, to alternately close or open the access opening 26 of a shower stall or tub enclosure 24. On the same dual purpose support guide member 1, slot 15 and the outer circumference of the support guide member 1 are both used to hold and traverse a decorative shower curtain 16 attached by hangers 7, to alternately close or open the access opening 26 of a shower stall or tub enclosure 24. The rollers 21 are round, each having two planar sides perpendicular to a rolling flat contact surface, which contact and communicate with the rectangular hollow interior of the dual purpose support guide member 1 perpendicular ends as it moves alternately between a first and a second fixed position on the holders 50 or 60. The dual purpose support guide member 1 has two distinct functions. The first is to hold and traverse a protective shower liner 14 attached to hangers 8. The second function is to hold and traverse a decorative shower curtain 16 attached to hangers 7. Both the shower liner 14 and the shower curtain 16 are able to traverse independently of each other on the same support guide member 1 to open or close the access opening 26 of a shower stall or tub enclosure 24.

Figure 14:
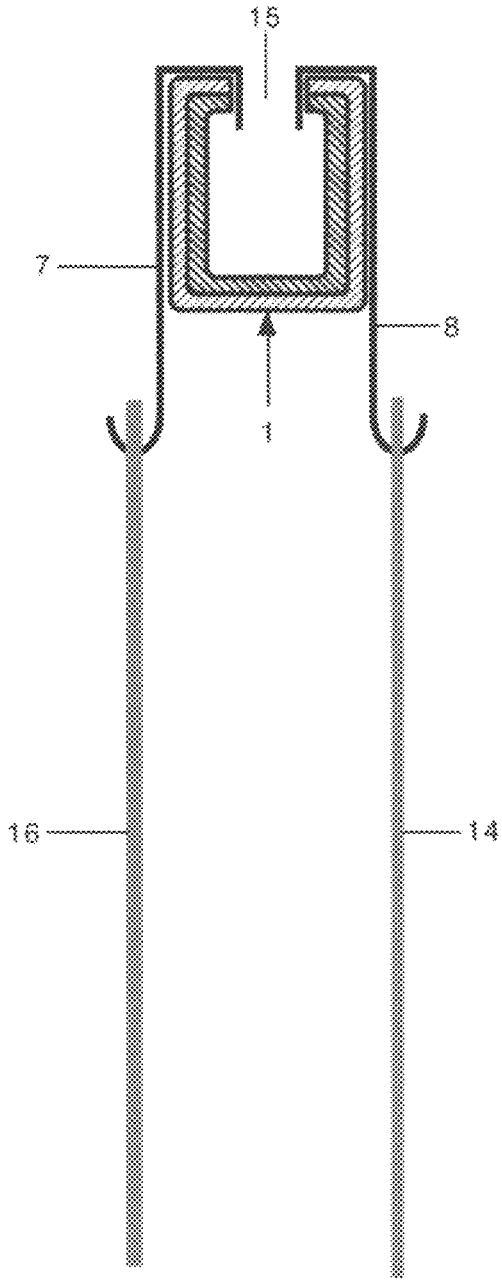
FIG. 14 shows an expanded cutaway view of another alternate embodiment of a support guide member, having an aperture on top of the support guide member for holding both a shower curtain and a liner, on opposite sides and independently movable of each other, with separate hangers for each.

FIG. 14 shows a variation of the dual-purpose support guide member 1 as illustrated in FIG. 12 and FIG. 13, instead having slots 15 disposed on the top planar surface of the center section and on a prescribed portion on both of the perpendicular ends of the dual-purpose support guide member 1. In this embodiment, hanger 7 holding shower curtain 16, and hanger 8 holding liner 14, are disposed in the same slot 15, hanging on opposite planar surfaces, and traversing independently of one another.

Figure 15:
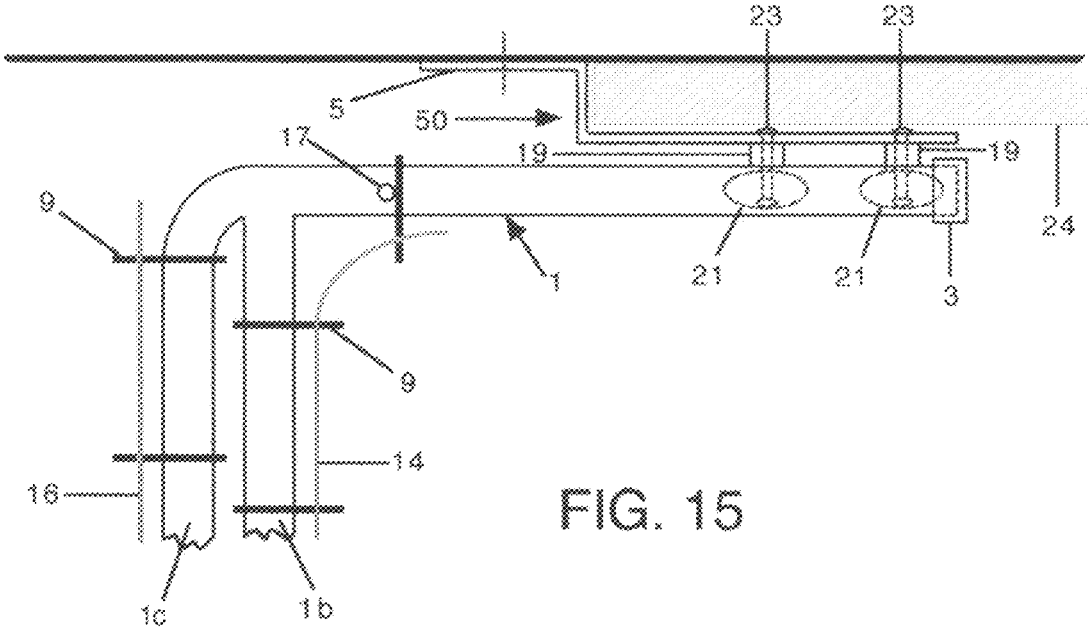
FIG. 15 shows a top or birds eye cutaway view of the left side portion of an alternate embodiment of the shower curtain support system, having two oval shaped center portions on the support guide member, with a shower liner and shower curtain attached by hooks, one to each of the two center portions. The right side portion, not shown, is a mirror image.
Figure 16:
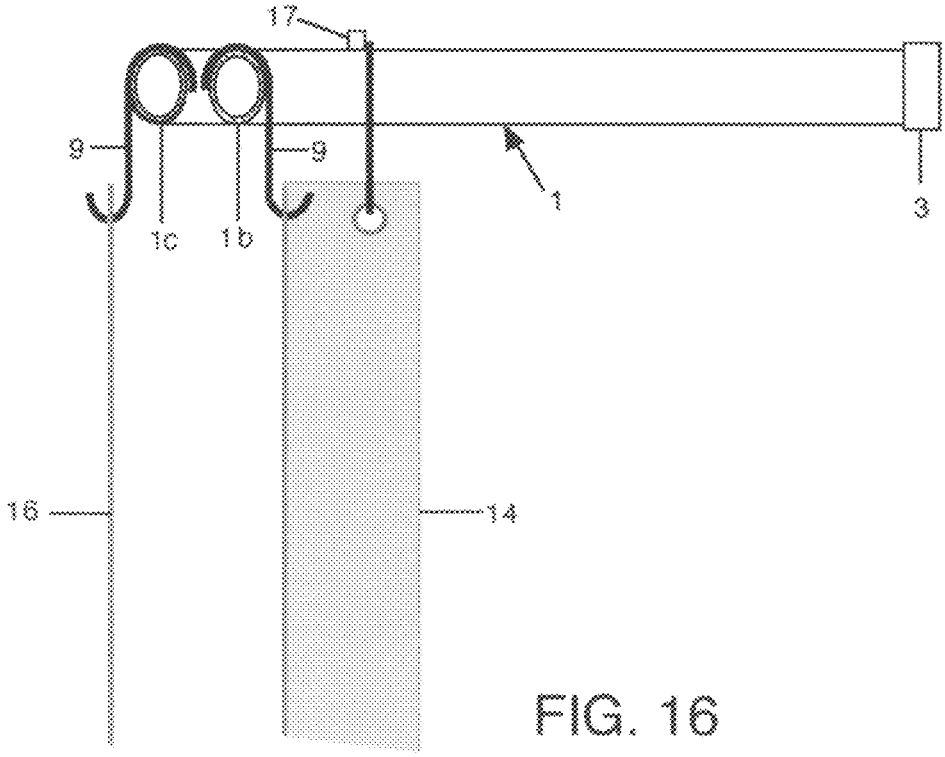
FIG. 16 shows a cross section end view of the left side portion of the alternate embodiment of the support guide member, having two oval shaped center portions, with a shower liner and shower curtain attached by hooks, one to each of the two center portions. The right side portion, not shown, is a mirror image.

FIGS. 15 and 16 show another embodiment of the shower curtain support system 100. The dual-purpose support guide member 1 is oval, as in the preferred embodiment, yet having two separate center sections 1*b* and 1*c*, comprising: an outer rod center section 1*c* for holding and traversing a shower curtain 16 with hangers 9, and an inner rod center section 1*b* for holding and traversing a shower liner 14 by means of other hangers 9. An appendage 17 is provided, one on each end of the dual-purpose support guide member 1, to retain hangers 9 around each end corner, in order to prevent water leakage around the shower liner 14 ends. Both the shower curtain 16 and the shower liner 14 are able to traverse the dual-purpose support guide member 1 independently of each other on separate center sections, 1*b* and 1*c*, of the same dual-purpose support guide member 1, so as to open or close the access opening 26 of a shower stall or tub enclosure 24.

Other configurations, such as slidable or slotted mechanisms, are anticipated, and may also be used to facilitate the telescoping movement of the shower curtain support system 100, extending and retracting between various positions, while still remaining within the spirit and scope of the present invention. It is also envisioned that the rollers 21 or other apparatus for moving a support guide member 1 may be reversed in position, with the rollers 21 attached to the support guide member 1 portion and the reciprocal communicating member attached to the shower wall. Although the invention has been described in the context of what is perceived to be the most practical and preferred embodiments, it should be understood that these embodiments shall not limit other disclosures, but, on the contrary, the invention is intended to include various modifications and other arrangements that are equivalent within the scope and spirit of the appended claims, and which scope thereof is to be accorded the broadest interpretation permitted under the law, so as to encompass all such modifications and equivalent structures. Further, while the shower curtain support system 100 is described for use within a home or dwelling, it should be understood that the shower curtain support system 100 of the present invention can also be used in a recreational vehicle, boat, hospital, or other environments, where applicable.

What is claimed is:

1. A shower curtain support system adapted to temporarily increase the space inside of a shower stall or bathtub enclosure so as to not permanently intrude into the space surrounding said shower stall or bathtub enclosure and thereby being more aesthetically pleasing when not in use, said shower curtain support system comprising:

a support guide member having opposing ends laterally extending from a center portion for supporting a shower curtain between at least two positions, said opposing ends further having a longitudinal slot the length thereof;

a pair of support guide holders, each one of said pair of support guide holders having a side face mounted to opposing walls of said shower stall or bathtub enclosure for holding said support guide member at said at least two positions;

each of said support guide holders having:

at least one aperture;

at least one fastener mounted in said at least one aperture;

a roller member mounted to said at least one fastener; and a spacer member mounted between said roller member and said support guide holder whereby said roller member extends in a direction away from said support guide holder to ride into said longitudinal slot of said hollow support guide member as said support guide member moves from one of said at least two positions to the other of said at least two positions such that at said one of said at least two positions said center portion of said hollow support guide member temporarily intrudes into said space surrounding said shower stall or bathtub enclosure and at said other of said at least two positions said center portion of said hollow support guide member is within said space defining said shower stall or bathtub enclosure to provide increased space to the user of said shower stall or bathtub enclosure during use thereof;

means for mounting said side face of said of pair of support guide holders to a respective one of said opposing walls surrounding said shower stall or bathtub enclosure.

2. The shower curtain support system as claimed in claim 1 wherein said pair of support guide holders further comprises:

a pair of elongated brackets, each one of said pair of elongated brackets configured for mounting to a respective one of said opposing walls surrounding said shower stall or bathtub enclosure; and each one of said pair of elongated brackets having at least one through aperture therein such that said at least one fastener, mounted in said at least one aperture of each respective one of said support guide members extends into said through aperture of a respective one of each of said pair of elongated brackets for mounting each one of said pair of elongated brackets to a respective one of said opposing walls surrounding said shower stall or bathtub enclosure.

3. The shower curtain support system as claimed in claim 1 further comprises said roller member being fixedly adjoined to said spacer member to form a unitary structure, said unitary structure having a through aperture therein.

4. The shower curtain support system as claimed in claim 1 wherein each of said pair of support guide holders is configured so as to be interchangeable as right or left hand.

5. The shower curtain support system as claimed in claim 1 wherein said support guide member further comprises:

a tubular member having:

opposing ends;

a hollow interior;

at least one aperture at each of said opposing ends;

an adjustable center portion;

means for fixedly positioning said support guide member on said pair of support guide holders; and means for retaining said support guide member on said pair of support guide holders.

6. The shower curtain support system as claimed in claim 1 further comprising a shower curtain liner and wherein said support guide member further comprises:

said center portion for supporting said shower curtain having:

a slotted aperture; and at least two hanger members, each hanger member having one end communicating with one of said shower curtain liner and said shower curtain for supporting and an opposing end extending into said slotted aperture to enable traversing of said one of said shower curtain liner and said shower curtain.

7. The shower curtain support system as claimed in claim 6 wherein said support guide member further comprises means for moving said shower curtain and said shower curtain liner independently of each other on said support guide member.

8. A shower curtain support system adapted to temporarily increase the space inside of a shower stall or bathtub enclosure so as to not permanently intrude into the space surrounding said shower stall or bathtub enclosure and thereby being more aesthetically pleasing when not in use, said shower curtain support system comprising:

a support guide member having opposing ends laterally extending from a center portion for supporting a shower curtain between at least two positions, said opposing ends further having a longitudinal slot the length thereof;

a pair of support guide holders, each one of said pair of support guide holders having a side face mounted to opposing walls surrounding said shower stall or bathtub enclosure for holding said support guide member at said at least two positions;

roller means engaging said longitudinal slot in said opposing ends of said support guide member for movably rolling said support guide member from a first position to a second position, said first position temporarily intruding into said space surrounding said shower stall or bathtub enclosure, said second position being within said space defining said shower stall or bathtub enclosure to provide increased space to the user of said shower stall or bathtub enclosure during use thereof.

9. The shower curtain support system as claimed in claim 1 wherein said spacer member is fixedly adjoined to said support guide holder to form a unitary structure, said unitary structure having a through aperture.

* * * * *